US005336971A

United States Patent [19]

Vermeulen et al.

[11] Patent Number: 5,336,971

[45] Date of Patent: Aug. 9, 1994

[54] ELECTRODELESS LOW-PRESSURE SODIUM VAPOR DISCHARGE LAMP HAVING A DISCHARGE VESSEL OF IMPROVED CONSTRUCTION

[75] Inventors: Adrianus J. A. Vermeulen; Robert J. Pet, both of Eindhoven, Netherlands

[73] Assignee: U.S. Philips Corporation, New York, N.Y.

[21] Appl. No.: 891,304

[22] Filed: May 29, 1992

[30] Foreign Application Priority Data

May 30, 1991 [EP] European Pat. Off. ..... 91201298.6

[51] Int. Cl.[5] ..... H01J 61/00

[52] U.S. Cl. ..... 313/635; 313/25; 313/493; 313/607; 313/234; 315/248

[58] Field of Search ..... 313/493, 635, 634, 636, 313/607, 234, 25, 562; 315/248, 344, 34

[56] References Cited

U.S. PATENT DOCUMENTS 4,209,726 1/1980 Jack et al. ..... 313/562
4,223,250 9/1980 Kramer et al. ..... 315/248
4,783,612 11/1988 Sprengers ..... 313/636
5,130,912 7/1992 Friederichs ..... 313/493
5,148,085 9/1992 Kroes ..... 315/248

*Primary Examiner*—Donald J. Yusko
*Assistant Examiner*—Nimesh D. Patel
*Attorney, Agent, or Firm*—William L. Botjer

[57] ABSTRACT

The electrodeless low pressure sodium vapour discharge lamp which has a discharge vessel (1) containing sodium vapour and inert gas. The discharge vessel (1) has an enveloping part (10) and connected therewith at a first end of the discharge vessel (1) a sunken part (20). In the sunken part (20) is a body (30) of soft-magnetic material which is surrounded by an electric coil (31). The discharge vessel (1) is enclosed in an outer bulb (40). The inner surface (2) of the discharge vessel (1) has a layer (4) of borate glass. The borate glass which covers the sunken part (20), is sintered. The invention renders it possible to make parts of construction glass which have a layer of borate glass at an outer surface.

3 Claims, 1 Drawing Sheet

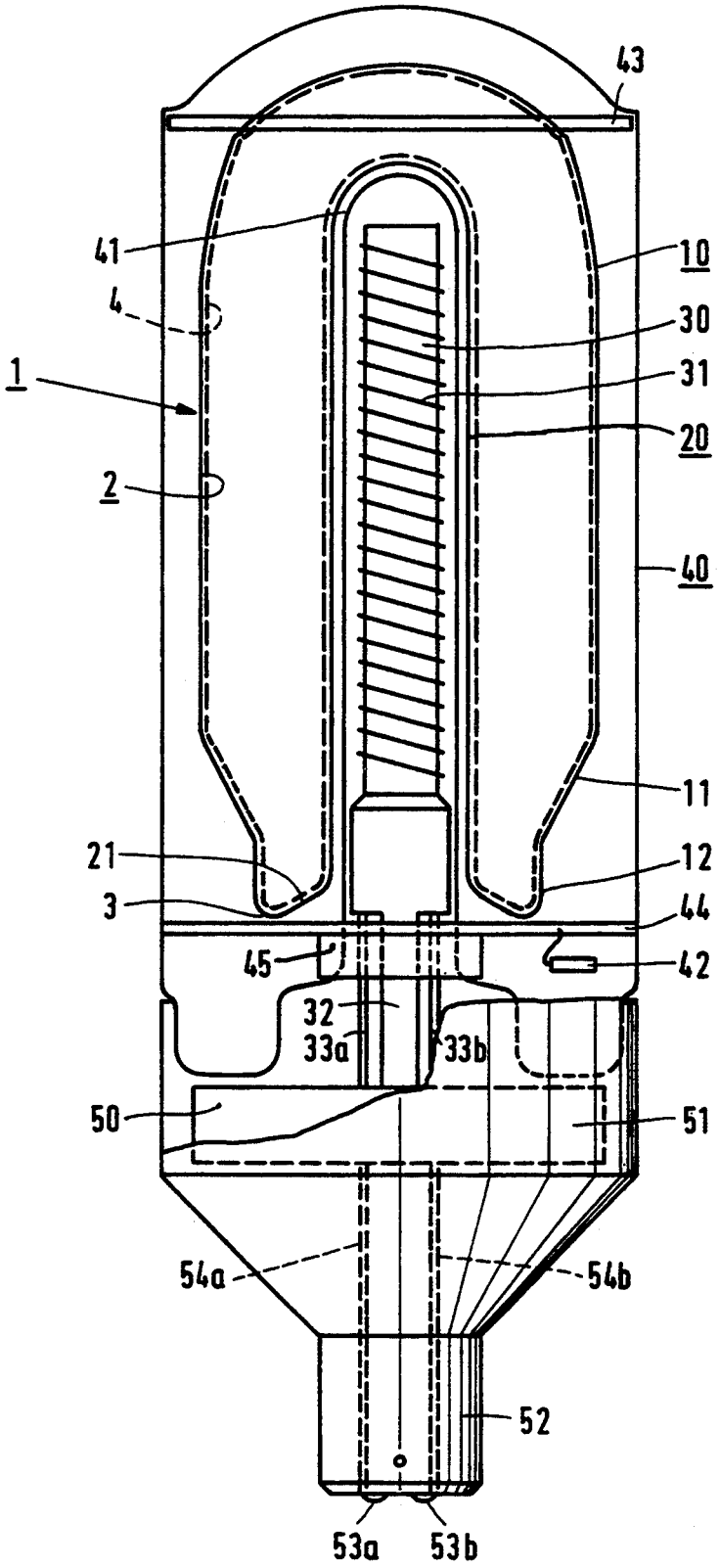
43
41
10
4
30
1
31
20
2
40
11
21
12
3
44
45
42
32
33a
33b
50
51
54a
54b
52
53a
53b

ELECTRODELESS LOW-PRESSURE SODIUM VAPOR DISCHARGE LAMP HAVING A DISCHARGE VESSEL OF IMPROVED CONSTRUCTION

BACKGROUND OF THE INVENTION

The invention relates to an electrodeless low-pressure sodium vapour discharge lamp comprising

- a discharge vessel which is closed in a vacuumtight manner, has an internal surface, and contains a filling comprising sodium vapour and rare gas, which discharge vessel comprises an enveloping part and a sunken part, which parts are interconnected at a first end of the discharge vessel,
- a body of soft magnetic material which is surrounded by an electric coil and which is provided together with said coil in the sunken part of the discharge vessel,
- an evacuated outer bulb in which the discharge vessel is accommodated.

Such a lamp is known from EP 0 298 538 A1 which corresponds to U.S. Pat. No. 4,922,157. Such a lamp is attractive inter alia because the discharge vessel has small dimensions for a given power compared with the discharge vessel of a conventional low-pressure sodium vapour discharge lamp, which is a tube bent into a U-shape having a seal at either end around an electric lead-through to an electrode. The light generated by an electrodeless lamp, therefore, can be better concentrated into a beam by means of a luminaire.

It has been found that construction glasses, i.e. glass types which have good mechanical properties and are easily processable on an industrial scale, for example lime glass, are not resistant to sodium vapour. To realize a sufficiently long operating life, the discharge vesel of the conventional lamp is accordingly made from a tube of construction glass which has on its inner surface a layer of the sodium-resistant borate glass. It is not possible in practice to manufacture the tube entirely from borate glass since this glass is strongly hygroscopic.

Such a conventional layered tube is made in a drawing process in which softened borate glass and softened construction glass flow through a first and a second circumferential slot, respectively, the first slot being situated concentrically inside the second slot. During this, a moisture-free gas flows through an opening situated centrally relative to the slots, which presses the inner layer of borate glass against the outer layer of construction glass. Since the gas is moisture-free and since the borate glass is surrounded by a shell of construction glass, a reaction of the borate glass with water is precluded. During storage and transport, reaction between the borate glass and water can be avoided in that the tubes are filled with a moisture-free gas and stoppered at the ends.

The enveloping part of the discharge vessel of an electrodeless low-pressure sodium vapour discharge lamp may be manufactured from a conventional layered tube.

In contrast to the enveloping part, the sunken part will find its outer surface in contact with sodium vapour. To protect also the sunken part against sodium vapour, therefore, it is necessary for the outer surface thereof to have a protective layer.

A drawing process in which glass tubing is made with a layer of borate glass at the outer surface has the disadvantage that reaction of the borate glass with water can only be prevented when the entire ambience in which the drawing process takes place is free from moisture. Reaction of the borate glass layer with water must also be avoided during storage and transport of such tubes.

To form the sunken part from such a layered tube it is necessary to close an end of the tube by sealing. If the tube is heated for this purpose from the outside, there is a risk that the borate glass contracts into drops in locations at the outer surface having a comparatively high temperature, so that portions of the tube no longer have a protective layer. It is true that the temperature profile in the borate layer can be more even in the case of heating of the tube from the inside, but this imposes stringent restrictions on the geometry of the heat source. In addition, this involves the risk that not only the end, but also other portions of the tube are softened, so that heat source gets jammed in the tube, or the body of soft magnetic material and the coil no longer fit in this tube.

SUMMARY OF THE INVENTION

The invention has for its object to provide an electrodeless low-pressure sodium vapour discharge lamp of the kind described in the opening paragraph having a discharge vessel which inter alia is easier to manufacture and which nevertheless has a construction which counteracts damage to the discharge vessel. In particular, the invention has for its object to provide an electrodeless low-pressure sodium vapour discharge lamp of the kind described in the opening paragraph having a discharge vessel which is easy to manufacture and which has a construction which counteracts attack of the discharge vessel by sodium vapour.

According to the invention, this object is achieved in that the internal surface of the discharge vessel has a layer of borate glass, of which at least the borate glass covering the sunken part is sintered.

To obtain the sunken part of the discharge vessel of the lamp according to the invention, for example, a body may be formed from a lime glass tube and provided at the outer surface with a layer of borate glass powder, which is subsequently sintered.

Since the borate glass need not be provided on the sunken part until after all shaping operations have been completed, these shaping operations are not hampered by the presence of borate glass. Therefore, the construction glass can be heated from the outside. Damage of the borate glass layer is also prevented in this way. The sunken part, after it has been provided with a layer of sintered borate glass, need only be connected to the enveloping part.

The enveloping part of the discharge vessel may be manufactured from a tube of construction glass, just as the sunken part, and be provided with a layer of sintered borate glass after having assumed a substantially final shape, but alternatively it may be obtained from, for example, a conventional layered tube.

The construction glass may be coated with borate glass particles, for example electrostatically, but alternatively the particles may, for example, be suspended in a suspension agent such as, for example, ethyl acetate, butyl acetate or ethanol, to which a binder such as, for example, nitrocellulose may be added. A suspension according to this description may be provided on the construction glass, for example, through immersion or spraying, and then be dried and sintered in that order.

Sintering causes the particles to grow together. Since the temperature is lower during this than in a process in which the borate glass is melted, deformations in the construction glass can be avoided. Cavities are present between the particles of borate glass on the construction glass. Cavities remain in the borate layer, also after sintering. The layer of sintered borate glass in the lamp according to the invention, therefore, has a dull appearance. The sunken part, however, need not transmit any light.

In a favourable embodiment, the borate glass comprises by weight 0 to 8% $SiO_2$, 13 to 26% $B_2O_3$, a total quantity of $SiO_2$ and $B_2O_3$ of between 15 and 30%, 0 to 20% $Al_2O_3$, and a total quantity of $SiO_2$ and $Al_2O_3$ of between 5 and 25%, a total quantity of alkaline earth metal oxides of between 55 and 85%, of which 40 to 65% BaO, and finally 0 to 3% alkali metal oxides. A layer of a borate glass whose composition lies within the above limits is found to have a very high resistance to sodium vapour, effectively protecting the construction glass.

The sunken part may be entirely tubular, for example, except for a sealed end remote from the first end, and may be connected to a spherical enveloping part. In a favourable embodiment, the sunken part has a portion which widens in a cone shape towards the first end of the discharge vessel, while the enveloping part is provided with a conically narrowing portion which merges into a substantially cylindrical neck-shaped portion which is connected to the conical portion of the sunken part. In this embodiment, mechanical stresses in the discharge vessel after evacuation thereof are sufficiently low, so that wastage owing to cracking of the discharge vessel is avoided. The enveloping part may, for example, have a hemispherical end portion remote from the first end and immediately adjoining the conical portion, so that the enveloping part has a pear shape, or the hemispherical end portion may alternatively be connected to the conical portion by means of a cylindrical portion.

BRIEF DESCRIPTION OF THE DRAWING

This and other aspects of the electrodeless low-pressure sodium vapour discharge lamp according to the invention will be explained in more detail with reference to the drawing. The FIGURE therein shows an embodiment in side elevation, partly broken away.

DETAILED DESCRIPTION OF THE PREFERRED EMBODIMENTS

In the FIGURE, the electrodeless low-pressure sodium vapour discharge lamp comprises a discharge vessel 1 which is closed in a vacuumtight manner and has an internal surface 2 and a filling of sodium vapour and rare gas, for example argon with a pressure of 20 to 500 Pa at room temperature, for example approximately 50 Pa. The discharge vessel 1 comprises an enveloping part 10 and a sunken part 20 which are interconnected at a first end 3 of the discharge vesel 1.

The lamp further comprises a body 30 of soft magnetic material, for example of ferrite, such as 4C6 ferrite, which is surrounded by an electric coil 31. The body 30 and the coil 31 are provided in the sunken part 20 of the discharge vessel 1.

Furthermore, the lamp comprises an evacuated outer bulb 40 in which the discharge vessel 1 is accommodated.

The body 30 and the coil 31 in the embodiment drawn are carried by a support 32, for example of synthetic material, and are surrounded by a recess 41 of the outer bulb 40 which enters the sunken part 20. A transparent annular disc 43 and a support plate 44 which cooperates with a sleeve 45 around the recess 41 keep the discharge vessel 1 in position. An evaporating getter, for example a barium getter, is introduced into the outer bulb 40 by means of a holder 42.

Current supply conductors **33*a*, 33*b* extend from the coil 31 to a supply unit 50, which is accommodated in a housing 51, which housing is connected to the outer bulb 40. The housing 51 has a lamp cap 52 with contacts 53*a*, 53*b* which are connected to the supply unit by means of current conductors 54*a*, 54*b*** (shown in broken lines).

In the embodiment shown, the discharge vessel 1 is made of lime glass. The internal surface 2 of the discharge vessel 1 has a layer 4 of borate glass (shown in broken lines), the borate glass which covers the sunken part 20 being sintered. Table 1 gives the composition of the lime glass (K1) and of the borate glass (B1) expressed in percents by weight. The composition of the borate glass lies within the limits given above. Two other examples of borate glasses are indicated with B2 and B3 in the Table. An alternative example of a construction glass is given as K2 in the Table.

TABLE 1

| | $B_2O_3$ | $SiO_2$ | $Al_2O_3$ | MgO | CaO | BaO | $Na_2O$ | $K_2O$ |
|---|---|---|---|---|---|---|---|---|
| B1 | 18.7 | 5.8 | 9.3 | 5.1 | 10.1 | 51.0 | — | — |
| B2 | 33.2 | — | 6.1 | 18.6 | 19.2 | 22.9 | — | — |
| B3 | 50.6 | 9.0 | 15.2 | — | 9.8 | — | 15.4 | — |
| K1 | — | 64.1 | 4.8 | 3.1 | 4.8 | 5.2 | 17.3 | 0.7 |
| K2 | — | 72.1 | 1.8 | 3.0 | 5.7 | — | 16.7 | 0.7 |

To provide the portion of the internal surface 2 of the lamp shown formed by the sunken part 20 with a layer 4 of borate glass, a suspension was prepared with the following composition:

100 g borate glass powder B1,
40 ml butyl acetate,
40 ml nitrocellulose.

The borate glass powder had a particle size distribution with a median at 2,9 μm. A layer of the said suspension was provided on the sunken part by immersion. The layer was then dried and subsequently sintered in a furnace at a temperature of 610° C. for three minutes.

The enveloping part of the discharge vessel was made from a conventional layered tube.

In the embodiment shown, the sunken part 20 has a conical portion 21 adjoining the first end 3 of the discharge vessel 1, which portion becomes wider in a direction towards the first end 3. The enveloping part 10 is provided with a portion 11 which narrows cortically in a direction towards the first end 3 and which merges into a substantially cylindrical neck-shaped portion 12 which is connected to the conical portion 21 of the sunken part 20.

The lamp shown had a luminous efficacy of 167,4 lm/W at a power load of 47,1 W. The lamp was found to have a good protection against attacks by sodium vapour.

We claim:

1. An electrodeless low-pressure sodium vapour discharge lamp having a discharge vessel which is closed in a vacuumtight manner, has an internal surface, and contains a filling comprising sodium vapour and rare gas, which discharge vessel comprises an enveloping part and a sunken part, which parts are interconnected at a first end of the discharge vessel, a body of soft magnetic material which is surrounded by an electric coil and which is provided together with said coil in the sunken part of the discharge vessel, an evacuated outer bulb in which the discharge vessel is accommodated, wherein the improvement comprises that the internal surface of the discharge vessel has a layer of borate glass, of which at least the borate glass covering the sunken part is sintered.

2. An electrodeless low-pressure sodium vapour discharge lamp as claimed in claim 1, wherein the borate glass comprises by weight 0 to 8% $SiO_2$, 13 to 26% $B_2O_3$, a total quantity of $SiO_2$ and $B_2O_3$ of between 15 and 30%, 0 to 20% $Al_2O_3$, and a total quantity of $SiO_2$ and $Al_2O_3$ of between 5 and 25%, a total quantity of alkaline earth metal oxides of between 55 and 85%, of which 40 to 65% BaO, and finally 0 to 3% alkali metal oxides.

3. An electrodeless low-pressure sodium vapour discharge lamp as claimed in claim 1, wherein the sunken part has a portion which widens in a cone shape towards the first end of the discharge vessel, while the enveloping part is provided with a conically narrowing portion which merges into a substantially cylindrical neck-shaped portion which is connected to the conical portion of the sunken part.

* * * * *